US009163880B2

(12) United States Patent
Shikazono et al.

(10) Patent No.: US 9,163,880 B2
(45) Date of Patent: Oct. 20, 2015

(54) HEAT EXCHANGER

(75) Inventors: Naoki Shikazono, Tokyo (JP); Tsunehito Wake, Tokyo (JP); Shiro Ikuta, Tokyo (JP)

(73) Assignees: THE UNIVERSITY OF TOKYO, Tokyo (JP); WAKI FACTORY INC., Tokyo (JP)

( * ) Notice: Subject to any disclaimer, the term of this patent is extended or adjusted under 35 U.S.C. 154(b) by 1274 days.

(21) Appl. No.: 12/450,233

(22) PCT Filed: Mar. 21, 2008

(86) PCT No.: PCT/JP2008/055322

§ 371 (c)(1),
(2), (4) Date: Sep. 17, 2009

(87) PCT Pub. No.: WO2008/117761

PCT Pub. Date: Oct. 2, 2008

(65) Prior Publication Data

US 2010/0089560 A1 Apr. 15, 2010

(30) Foreign Application Priority Data

Mar. 23, 2007 (JP) ..... 2007-076588

(51) Int. Cl.

| | |
|---|---|
| ***F28F 13/12*** | (2006.01) |
| ***F28F 1/06*** | (2006.01) |
| ***F28F 1/42*** | (2006.01) |
| ***F28D 1/053*** | (2006.01) |
| ***F28F 1/08*** | (2006.01) |
| ***F28F 1/10*** | (2006.01) |

(Continued)

(52) U.S. Cl.

CPC ..... *F28D 1/05366* (2013.01); *F28F 1/06* (2013.01); *F28F 1/08* (2013.01); *F28F 1/10* (2013.01);

(Continued)

(58) Field of Classification Search

CPC ..... F28F 1/06; F28F 1/42; F28F 1/426; F28F 13/12

USPC ..... 165/109.1, 170, 17, 179, 177

See application file for complete search history.

(56) References Cited

U.S. PATENT DOCUMENTS 1,505,701 A * 8/1924 Cox ..... 165/148
2,017,201 A * 10/1935 Bossart et al. ..... 165/177

(Continued)

FOREIGN PATENT DOCUMENTS

JP U-59-065272 5/1984
JP A-01-219497 9/1989

(Continued)

OTHER PUBLICATIONS

Jan. 28, 2010 International Preliminary Report on Patentability issued in International Application No. PCT/JP2008/055322.

*Primary Examiner* — Leonard R Leo
(74) *Attorney, Agent, or Firm* — Oliff PLC

(57) ABSTRACT

A heat exchanger assembled from multiple heat exchanging tubes. Each of the multiple heat exchanging tubes is formed as a flattened tube of 0.5 mm in thickness by press work or bending work of a stainless steel plate member having a thickness of 0.1 mm. Each of the multiple heat exchanging tubes is structured to have multiple lines of sequential wave crests and multiple lines of sequential wave troughs formed on each of flattened faces of the heat exchanging tube. The multiple lines of the sequential wave crests and the multiple lines of the sequential wave troughs are arranged to have a preset angle γ relative to a main stream of an air flow. The lines of the sequential wave crests and the lines of the sequential wave troughs are symmetrically folded back about folding lines arranged at a preset interval W along the main stream of the air flow.

14 Claims, 8 Drawing Sheets

(51) Int. Cl.

| | |
|---|---|
| ***F28F 1/16*** | (2006.01) |
| ***F28F 1/34*** | (2006.01) |
| ***F28F 1/38*** | (2006.01) |
| ***F28F 1/40*** | (2006.01) |
| ***F28F 3/04*** | (2006.01) |
| ***F28F 13/06*** | (2006.01) |

(52) U.S. Cl.
CPC ... *F28F 1/16* (2013.01); *F28F 1/34* (2013.01); *F28F 1/38* (2013.01); *F28F 1/40* (2013.01); *F28F 1/42* (2013.01); *F28F 1/426* (2013.01); *F28F 3/046* (2013.01); *F28F 13/06* (2013.01)

(56) References Cited

U.S. PATENT DOCUMENTS

| | | | | | |
|---|---|---|---|---|---|
| 4,332,291 | A | * | 6/1982 | Mulock-Bentley | 165/76 |
| 4,470,452 | A | * | 9/1984 | Rhodes | 165/179 |
| 4,657,072 | A | * | 4/1987 | Mulock-Bentley | 165/179 |
| 4,932,469 | A | * | 6/1990 | Beatenbough | 165/170 |
| 5,538,700 | A | * | 7/1996 | Koves | 165/166 |
| 5,692,559 | A | * | 12/1997 | Cheong | 165/170 |
| 6,334,985 | B1 | * | 1/2002 | Raghuram et al. | 165/166 |
| 6,749,817 | B1 | * | 6/2004 | Mulvaney, III | 165/170 |
| 2003/0029608 | A1 | | 2/2003 | Shimoya | |
| 2008/0264098 | A1 | | 10/2008 | Shikazono et al. | |

FOREIGN PATENT DOCUMENTS

| | | |
|---|---|---|
| JP | A-2001-167782 | 6/2001 |
| JP | A-2002-090081 | 3/2002 |
| JP | A-2004-003787 | 1/2004 |
| JP | A-2004-218969 | 8/2004 |
| WO | WO 92/08941 A1 | 5/1992 |
| WO | WO 2007/013623 A1 | 2/2007 |

* cited by examiner

HEAT EXCHANGER

TECHNICAL FIELD

The present invention relates to a heat exchanger, and more specifically pertains to a heat exchanger designed to have multiple heat exchanging tubes, which are made of a thermally conducting material, are formed as hollow tubes of a flattened cross section, and are arranged in parallel with one another, and configured to cool down or heat up a heat exchanging fluid through heat exchange between the heat exchanging fluid flowing inside the multiple heat exchanging tubes and a heat exchanged fluid flowing between the multiple heat exchanging tubes.

BACKGROUND ART

One proposed structure of the heat exchanger has multiple tubes arranged to make circulation of a refrigerant between a refrigerant inlet tank and a refrigerant outlet tank and thereby perform heat exchange with the outside air (see, for example, Japanese Patent Laid-Open No. 2001-167782). In the heat exchanger of this prior art structure, as the refrigerant introduced into the inlet tank flows in the multiple tubes and reaches the outlet tank, the refrigerant is cooled down by heat exchange with the outside air flowing between the multiple tubes in a direction substantially perpendicular to the multiple tubes. Cooling fins are provided between the multiple tubes to enhance the efficiency of heat exchange.

Another proposed structure of the heat exchanger has multiple small-diameter tubes arranged to make circulation of a refrigerant between two headers formed as an inlet and an outlet of a refrigerant and thereby perform heat exchange with the outside air (see, for example, Japanese Patent Laid-Open No. 2004-218969). In the heat exchanger of this prior art structure, as the refrigerant flows in and between the multiple small-diameter tubes, the refrigerant is cooled down by heat exchange with the outside air.

Still another proposed structure of the heat exchanger has multiple flattened hollow tubes of a flattened cross section, in order to increase an effective area of heat transfer. This prior art heat exchanger is constructed as a finless heat exchanger with no cooling fans, in order to lower a potential pressure loss of a fluid flowing between the flattened tubes and attain size reduction of the heat exchanger.

DISCLOSURE OF THE INVENTION

The amount of heat generated from a drive power source of, for example, a personal computer or a robot is significantly smaller than the amount of industrial waste heat. The amount of heat generation per unit area and per unit time may, however, reach several ten times as much as the amount of industrial waste heat. The power source is generally covered with a heat insulator, which facilitates accumulation of heat. The presence of the heat insulator enables the heat generation source to be cooled down not directly but only via the heat insulator. This leads to an unnecessarily large amount of waste heat. The requirement of size reduction limits the attachment location of the heat exchanger. The weight reduction is also demanded for the heat exchanger.

Further improvement of the thermal efficiency and purification of exhaust emission have recently been desired for engines and fuel cells. It is thus required to effectively recover and reuse the heat of the exhaust emission and cool down the air supply or the exhaust emission for the lower combustion temperature. In recovery of exhaust heat or cooling of the air supply or the exhaust emission, the acidity of condensate water and the efficient drainage of condensate water would be demanded. The stainless steel material with excellent corrosion resistance has relatively low thermal conductivity, so that the stainless steel fins have the lowered efficiency. The presence of the fins may interfere with the outflow of condensate water and thereby with efficient heat exchange.

In the heat exchanger of the prior art structure equipped with the multiple flattened tubes, an increase of the internal pressure in the flattened tube may deform its flattened surface outward. Such deformation undesirably increases the flow resistance of the fluid flowing between the flattened tubes and reduces the amount of heat exchange.

There would thus be a demand for improving the efficiency of heat exchange in a heat exchanger. Another demand would be size reduction of the heat exchanger.

The present invention accomplishes at least part of the demand mentioned above and the other relevant demands by the following configurations applied to the heat exchanger.

The present invention is directed to a heat exchanger constructed to have multiple heat exchanging tubes, which are made of a thermally conducting material, are formed as hollow tubes of a flattened cross section, and are arranged in parallel with one another. The heat exchanger is configured to cool down or heat up a heat exchanging fluid through heat exchange between the heat exchanging fluid flowing inside the multiple heat exchanging tubes and a heat exchanged fluid flowing between the multiple heat exchanging tubes. In the heat exchanger, each of the multiple heat exchanging tubes is structured to have a line of sequential wave crests and a line of sequential wave troughs formed on at least one of an outer wall face and an inner wall face of the heat exchanging tube for making flows of the respective fluids thereon, the line of sequential wave crests and the line of sequential wave troughs being arranged to have a preset angle in a specific angle range of 10 degrees to 60 degrees relative to a predetermined direction and being symmetrically folded back about folding lines arranged at a preset interval along the predetermined direction.

In the heat exchanger according to this aspect of the invention, each of the multiple heat exchanging tubes is structured to have the line of sequential wave crests and the line of sequential wave troughs formed on at least one of the outer wall face and the inner wall face of the heat exchanging tube for making flows of the respective fluids thereon. The line of sequential wave crests and the line of sequential wave troughs are arranged to have the preset angle in the specific angle range of 10 degrees to 60 degrees relative to the predetermined direction and are symmetrically folded back about folding lines arranged at the preset interval along the predetermined direction. The presence of the line of sequential wave crests and the line of sequential wave troughs formed on the outer wall face or the inner wall face of each of the multiple heat exchanging tubes enables the eddies of the secondary flows generated in the course of the fluid flow to function as an effective secondary flow component for acceleration of heat transfer. This arrangement thus improves the efficiency of heat exchange in the heat exchanger and gives the high-performance, small-sized heat exchanger. The 'predetermined direction' is preferably a main stream direction of the fluid flow but is not restricted to this direction. The 'predetermined direction' may be a direction having a preset angle to the main stream direction of the fluid flow. The multiple heat exchanging tubes are preferably assembled to make the flow of the heat exchanging fluid substantially perpendicular to the flow of the heat exchanged fluid as a whole. This arrangement is, however, neither essential nor restrictive. In one modification, the multiple heat exchanging tubes may be assembled to make the flow of the heat exchanging fluid intersect with the flow of the heat exchanged fluid at a preset angle. In another modification, the multiple heat exchanging tubes may be assembled to make the flow of the heat exchanging fluid opposed to the flow of the heat exchanged fluid.

In the heat exchanger in accordance with present invention, each of the multiple heat exchanging tubes may be structured to have the line of sequential wave crests and the line of sequential wave troughs formed on a specific face for making thereon a flow of a fluid having a lower thermal conductivity between the heat exchanging fluid and the heat exchanged fluid. Formation of the line of sequential wave crests and the line of sequential wave troughs on the specific face for making thereon the flow of the fluid having the lower thermal conductivity increases the amount of heat transfer to the fluid having the lower thermal conductivity. This arrangement assures the high efficiency of the heat exchanger. In this case, each of the multiple heat exchanging tubes may be structured to have the line of sequential wave crests and the line of sequential wave troughs formed on an opposed face for making thereon a flow of a fluid having a higher thermal conductivity between the heat exchanging fluid and the heat exchanged fluid, in such a manner as to be arranged in a pair and in parallel with the line of sequential wave crests and the line of sequential wave troughs formed on the specific face for making thereon the flow of the fluid having the lower thermal conductivity. This arrangement is applicable to, for example, a method of forming lines of sequential wave crests and lines of sequential wave troughs simultaneously with production of each heat exchanging tube by press work of a thin plate. In this application, the thin plate itself is worked to be corrugated, so that the line of sequential wave crests and the line of sequential wave troughs formed on the outer wall face of the produced heat exchanging tube is integrated with and arranged in a pair with and parallel to the line of sequential wave crests and the line of sequential wave troughs formed on the inner wall face of the produced heat exchanging tube. In the application of forming the lines of sequential wave crests and the lines of sequential wave troughs on both the outer wall face and the inner wall face, it is not essential to make the line of sequential wave crests and the line of sequential wave troughs on the outer wall face in a pair with and parallel to the line of sequential wave crests and the line of sequential wave troughs on the inner wall face. In one modification, the line of sequential wave crests and the line of sequential wave troughs on the outer wall face may be formed separately in a different direction from the line of sequential wave crests and the line of sequential wave troughs on the inner wall face.

Also, in the heat exchanger in accordance with present invention, each of the multiple heat exchanging tubes may be structured to have the line of sequential wave crests and the line of sequential wave troughs formed on at least the outer wall face thereof, and the multiple heat exchanging tubes may be assembled in such a manner as to make a line of sequential wave crests and a line of sequential wave troughs on the outer wall face of one heat exchanging tube parallel to a line of sequential wave crests and a line of sequential wave troughs on the outer wall face of an adjacent heat exchanging tube. In this application, the multiple heat exchanging tubes are assembled in such a manner as to make the line of sequential wave crests and the line of sequential wave troughs on the outer wall face of one heat exchanging tube parallel to the line of sequential wave crests and the line of sequential wave troughs on the outer wall face of an adjacent heat exchanging tube. This arrangement desirably lowers the flow resistance of the heat exchanged fluid, compared with a comparative arrangement of making the line of sequential wave crests and the line of sequential wave troughs on the outer wall face of one heat exchanging tube opposed to the line of sequential wave crests and the line of sequential wave troughs on the outer wall face of an adjacent heat exchanging tube.

Further, in the heat exchanger in accordance with present invention, each of the multiple heat exchanging tubes may be structured to have the line of sequential wave crests and the line of sequential wave troughs arranged to satisfy inequality that $1.3\times Re^{-0.5}<a/p<0.2$, where 'a' denote an amplitude of a waveform including one wave crest from the line of sequential wave crests and one wave trough from the line of sequential wave troughs, 'p' denotes a pitch as an interval between the line of sequential wave crests and the line of sequential wave troughs formed on one face and the line of sequential wave crests and the line of sequential wave troughs formed on an opposed face arranged to be opposite to the one face across a fluid flow, and 'Re' denotes a Reynolds number defined by a bulk flow rate and the pitch 'p'. The heat exchanger of this application enables the eddies of the secondary flows generated in the course of the fluid flow to function as an effective secondary flow component for acceleration of heat transfer without being affected by the opposed wall face across the fluid flow. This arrangement gives the higher-performance, small-sized heat exchanger having the higher efficiency of heat exchange.

Alternatively, in the heat exchanger in accordance with present invention, each of the multiple heat exchanging tubes may be structured to have the line of sequential wave crests and the line of sequential wave troughs arranged to satisfy inequality that $0.25<W/z<2.0$, where 'W' denotes the preset interval of the folding lines and 'z' denotes a wavelength of a waveform including one wave crest from the line of sequential wave crests and one wave trough from the line of sequential wave troughs. The heat exchanger of this application prevents an increase in ratio of a span direction moving distance of the secondary flow component to a vertical direction distance to an opposed wall face. This arrangement keeps a high level of the secondary flow component effective for acceleration of heat transfer. This arrangement gives the higher-performance, small-sized heat exchanger having the higher efficiency of heat exchange.

Also, in the heat exchanger in accordance with present invention, each of the multiple heat exchanging tubes may be structured to have the line of sequential wave crests and the line of sequential wave troughs arranged to satisfy inequality that $0.25<r/z$, in which 'r' denotes a radius of curvature at a top of each wave crest from the line of sequential wave crests and/or at a bottom of each wave trough from the line of sequential wave troughs and 'z' denotes a wavelength of a waveform including one wave crest from the line of sequential wave crests and one wave trough from the line of sequential wave troughs. The heat exchanger of this application effectively controls a local speed multiplication of the fluid flow running along the waveforms of the wave crests and the wave troughs. This arrangement desirably prevents an increase of the flow resistance. This arrangement gives the higher-performance, small-sized heat exchanger having the higher efficiency of heat exchange.

In addition, in the heat exchanger in accordance with present invention, each of the multiple heat exchanging tubes may be structured to have the line of sequential wave crests and the line of sequential wave troughs arranged to have an angle of inclination of not less than 25 degrees on a cross section of a waveform including one wave crest from the line of sequential wave crests and one wave trough from the line of sequential wave troughs. The heat exchanger of this application enhances the secondary flow component along the waveforms of the wave crests and the wave troughs. The enhanced secondary flow component effectively generates the secondary flows contributing to heat transfer and increases an effective area for heat transfer of inclined planes on the cross section of the waveforms of the wave crests and the wave troughs. This arrangement gives the higher-performance, small-sized heat exchanger having the higher efficiency of heat exchange.

Also, in the heat exchanger in accordance with present invention, each of the multiple heat exchanging tubes may be made of a metal material and is formed as a flattened hollow tube of a cross section having a thickness of not greater than 9 mm. Moreover, each of the multiple heat exchanging tubes may be made of a plate member having a thickness of not greater than 1.5 mm.

BEST MODES OF CARRYING OUT THE INVENTION

Figure 1:
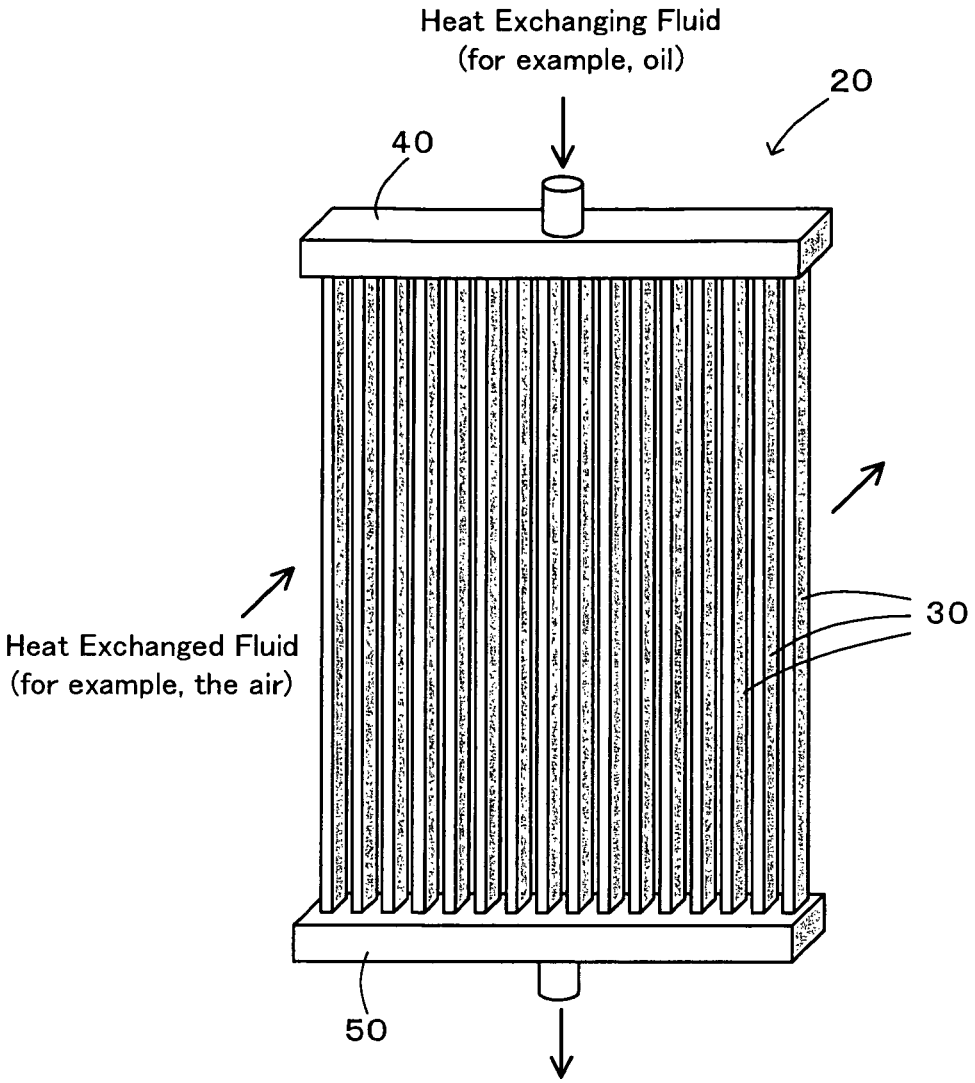
FIG. 1 is an outline view showing the appearance of a heat exchanger 20 in one embodiment of the invention.
Figure 2:
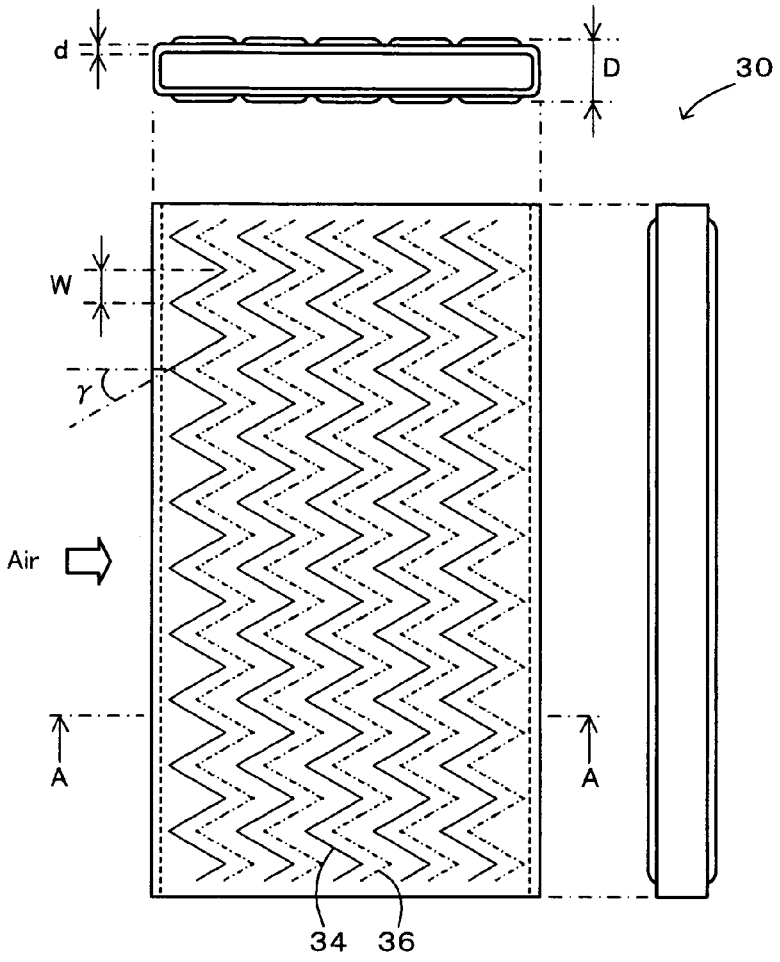
FIG. 2 is an explanatory view showing a top face, a front face, and a side face of a heat exchanging tube 30 used for the heat exchanger 20 of the embodiment.
Figure 3:
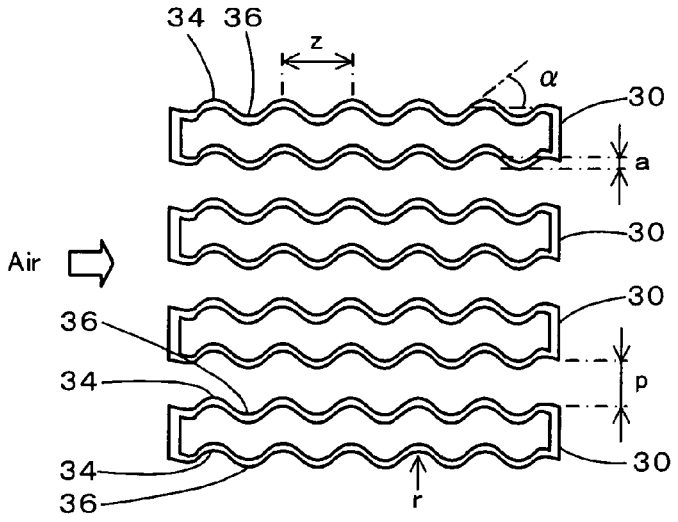
FIG. 3 is a sectional explanatory view showing A-A cross sections of plurality of the heat exchanging tubes 30 shown in FIG. 2.

One mode of carrying out the invention is discussed below as a preferred embodiment with reference to the accompanied drawings. FIG. 1 is an outline view showing the appearance of a heat exchanger 20 in one embodiment of the invention. FIG. 2 is an explanatory view showing a top face, a front face, and a side face of a heat exchanging tube 30 used for the heat exchanger 20 of the embodiment. FIG. 3 is a sectional explanatory view showing A-A cross sections of plurality of the heat exchanging tubes 30 shown in FIG. 2. As illustrated, the heat exchanger 20 of the embodiment includes multiple heat exchanging tubes 30 that are formed as flattened hollow tubes and are arranged in parallel with one another, and a pair of headers 40 and 50 that are provided to cover respective ends of the multiple heat exchanging tubes 30 and to make an inflow and an outflow of a heat exchanging fluid into and from the multiple heat exchanging tubes 30.

Each of the heat exchanging tubes 30 is formed as a flattened tube of 0.5 mm in thickness by press work or bending work of a 0.1 mm-thick plate of a thermally conducting material, such as a stainless steel material. An outer wall side of each of the flattened faces (front face and rear face) of the heat exchanging tube 30 is designed to have multiple lines of sequential wave crests (convexes) 34 shown by solid lines in FIG. 2 and multiple lines of sequential wave troughs (concaves) shown by one-dot chain lines in FIG. 2 and arranged alternately with the lines of the sequential wave crests 34. The multiple lines of the sequential wave crests 34 and the multiple lines of the sequential wave troughs 36 on the front face are arranged to be parallel to the multiple lines of the sequential wave crests 34 and the multiple lines of the sequential wave troughs 36 on the rear face. An inner wall side of each of the flattened faces of the heat exchanging tube 30 is designed to have multiple lines of sequential wave troughs (concaves) as a reversed shape of the multiple lines of the sequential wave crests 34 formed on the outer wall side, as well as multiple lines of sequential wave crests (convexes) as a reversed shape of the multiple lines of the sequential wave troughs 36 formed on the outer wall side. Namely each of the flattened faces (front face and rear face) of the heat exchanging tube 30 is formed of a corrugated plate with the multiple lines of the sequential wave crests (convexes) 34 and the multiple lines of the sequential wave troughs (concaves) 36, except both ends thereof. In the heat exchanger 20 of the embodiment, an heat exchanging fluid (for example, water or oil) is flowed inside each of the heat exchanging tubes 30 downward from an upper side to a lower side on the front face of FIG. 2. As shown in the front face of FIG. 2 and FIG. 3, a heat exchanged fluid (for example, the air) is flowed substantially perpendicular to the flow of the heat exchanging fluid inside the heat exchanging tubes 30. The heat exchanger 20 is constructed to cool down or heat up the heat exchanging fluid through heat exchange between the heat exchanging fluid and the heat exchanged fluid. In the description below, oil and the air are respectively used for the heat exchanging fluid and for the heat exchanged fluid.

Figure 4:
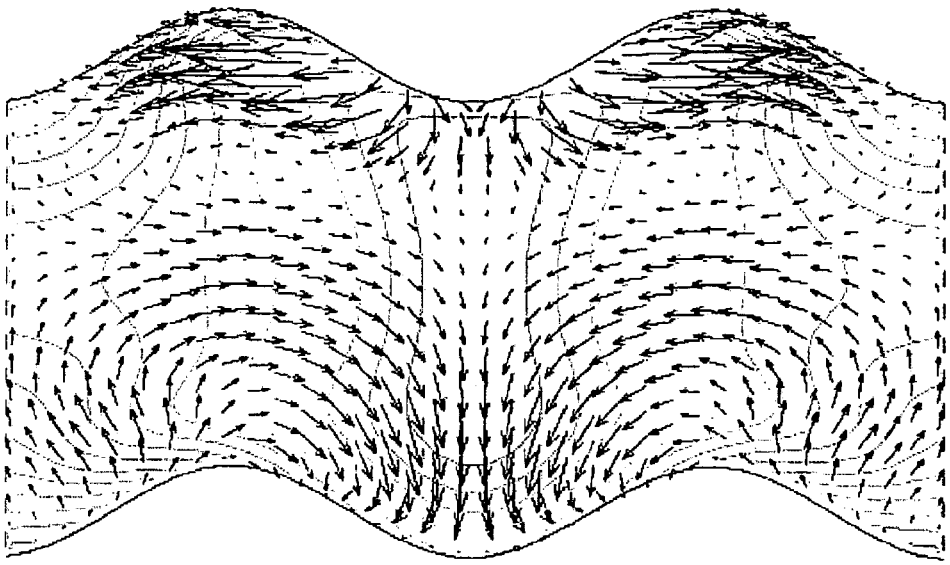
FIG. 4 is an explanatory view showing isothermal lines with secondary flows of the air generated on a corrugated plate by introduction of a low flow-rate, homogeneous flow of the air onto the corrugated plate.

The multiple lines of the sequential wave crests 34 and the multiple lines of the sequential wave troughs 36 (respectively shown by the solid lines and by the one-dot chain lines) formed on each of the flattened faces (front face and rear face) of the heat exchanging tube 30 are arranged to have a preset angle γ, for example, 30 degrees, in a specific angle range of 10 degrees to 60 degrees relative to the main stream of the air flow (a flow from a left side to a right side on the front face of FIG. 2). The lines of the sequential wave crests 34 and the lines of the sequential wave troughs 36 are symmetrically folded back about folding lines (non-illustrated lines of connecting flexion points of the solid lines with those of the one-dot chain lines of FIG. 2) arranged at a preset interval (folding interval) W along the main stream of the air flow. The effective secondary flows of the air can be generated by this arrangement of the heat exchanging tube 30 where the multiple lines of the sequential wave crests 34 and the multiple lines of the sequential wave troughs 36 (shown by the solid lines and the one-dot chain lines) are arranged at the preset angle γ in the specific angle range of 10 degrees to 60 degrees relative to (the main stream of) the air flow. FIG. 4 shows isothermal lines with secondary flows of the air (shown by arrows) generated on a corrugated plate by introduction of a low flow-rate, homogeneous flow of the air onto the corrugated plate. As illustrated, strong secondary flows of the air are generated in the presence of the wave crests 34 and the wave troughs 36. There is accordingly a significant temperature gradient in a neighborhood of the wall face. In the structure of the embodiment, the multiple lines of the sequential wave crests 34 and the multiple lines of the sequential wave troughs 36 (respectively shown by the solid lines and the one-dot chain lines) are arranged to have the angle γ of 30 degrees relative to the main stream of the air flow. This arrangement aims to generate the effective secondary flows of the air. The excessively small angle γ fails to generate the effective secondary flows of the air. The excessively large angle γ, on the other hand, undesirably interferes with the smooth air flow along the wave crests 34 and the wave troughs 36 and causes separation of the air flow or a local speed multiplication of the air flow, thus increasing the ventilation resistance. In order to generate the effective secondary flows of the air, the angle γ should be an acute angle and is preferably in a range of 10 degrees to 60 degrees, more preferably in a range of 15 degrees to 45 degrees, and most preferably in a range of 25 degrees to 35 degrees. The structure of this embodiment accordingly adopts 30 degrees for the angle γ. In the condition of the low air flow, the main stream of the air flow on the corrugated plate with the wave crests 34 and the wave troughs 36 is kept substantially equivalent to the main stream of the air flow on a simple flat plate without the wave crests 34 and the wave troughs 36, while the effective secondary flows of the air are generated in the presence of the wave crests 34 and the wave troughs 36. In the structure of the embodiment, the angle γ is fixed to 30 degrees. The angle γ is, however, not necessarily fixed but may be varied to draw curved lines of the sequential wave crests 34 and curved lines of the sequential wave troughs 36. Because of the following reason, the multiple lines of the sequential wave crests 34 and the multiple lines of the sequential wave troughs 36 are formed on each of the flattened faces (front face and rear face) of the heat exchanging tube 30 to have the angle γ in the specific angle range of 10 degrees to 60 degrees relative to the main flow of the air. The air selected for the heat exchanged fluid flowing outside the heat exchanging tubes 30 has the lower thermal conductivity than the oil selected for the heat exchanging fluid flowing inside the heat exchanging tubes 30. The enhanced thermal conductivity to the air flow improves the performance of the heat exchanger 20.

The heat exchanger 20 of the embodiment is assembled by arranging the multiple heat exchanging tubes 30 in such a manner that the wave crests 34 and the wave troughs 36 formed on the outer wall side of each heat exchanging tube 30 are parallel to the wave crests 34 and the wave troughs 36 formed on the outer wall side of an adjacent heat exchanging tube 30 as shown in FIG. 3. In the structure of the embodiment, the wave crests 34 formed on one face of each heat exchanging tube 30 are opposed to the wave troughs 36 formed on an opposite face of an adjacent heat exchanging tube 30. Similarly the wave troughs 36 formed on one face of each heat exchanging tube 30 are opposed to the wave crests 34 formed on the opposite face of the adjacent heat exchanging tube 30. This arrangement lowers the ventilation resistance of the air flowing between the heat exchanging tubes 30. The heat exchanger 20 of the embodiment having this arrangement has a lower ventilation resistance than a heat exchanger having a comparative arrangement where the wave crests 34 formed on one face of each heat exchanging tube 30 are opposed to the wave crests 34 formed on an opposite face of an adjacent heat exchanging tube 30 and the wave troughs 36 formed on one face of each heat exchanging tube 30 are opposed to the wave troughs 36 formed on the opposite face of the adjacent heat exchanging tube 30.

The multiple heat exchanging tubes 30 are assembled to the heat exchanger 20 of the embodiment. Each of the heat exchanging tubes 30 is designed to have an amplitude-to-pitch ratio (a/p) satisfying Inequality (1) given below:

$$1.3\times Re^{-0.5}<a/p<0.2 \quad (1)$$

Figure 5:
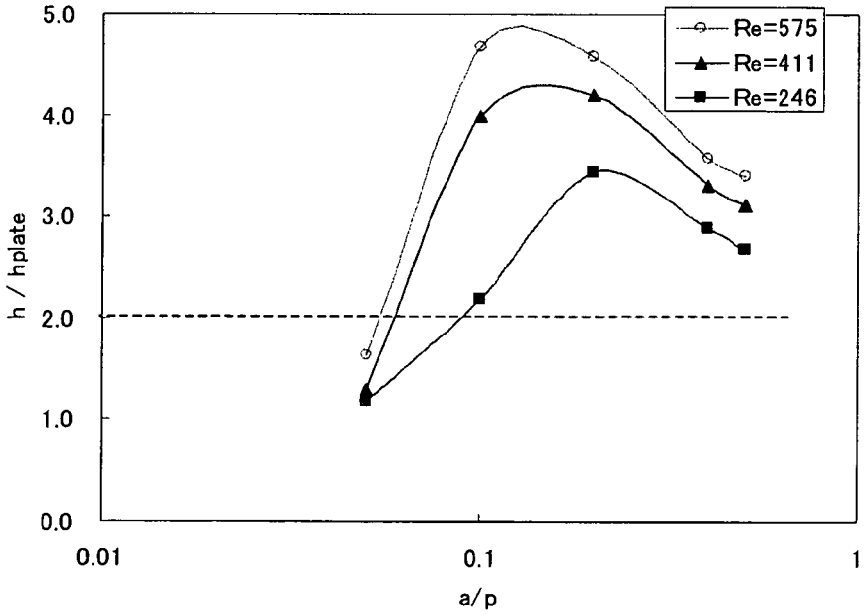
FIG. 5 is a graph showing a computation result of variations in improvement rate (h/hplate) of the heat transfer coefficient against the amplitude-to-pitch ratio (a/p) with regard to various values of the Reynolds number Re.
Figure 6:
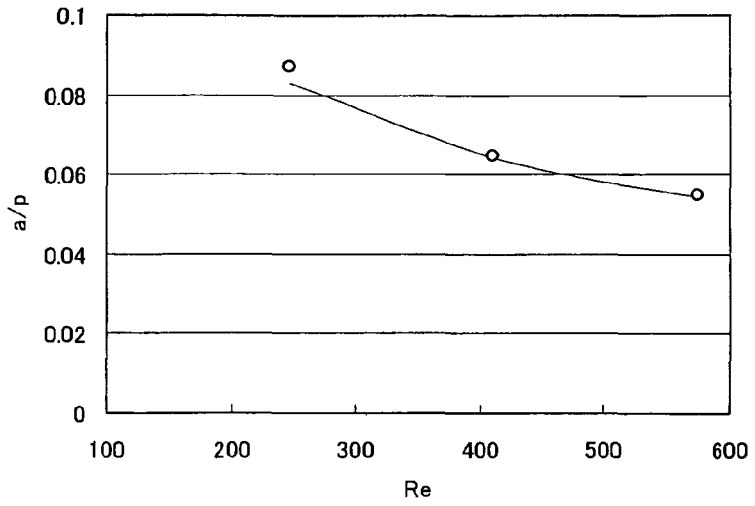
FIG. 6 is a graph showing a computation result of a variation in amplitude-to-pitch ratio (a/p) against the Reynolds number Re to give a heat transfer coefficient of not less than double the heat transfer coefficient of a comparative example.
Figure 7:
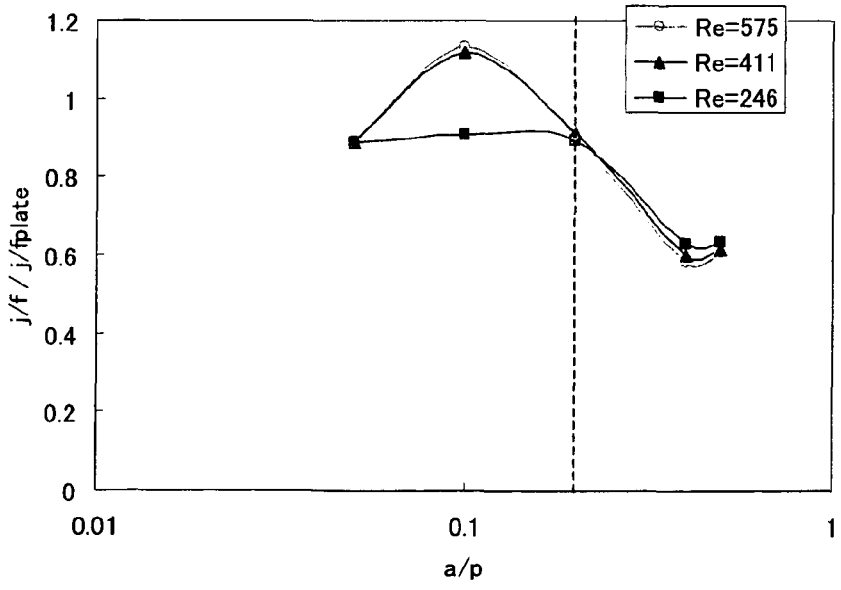
FIG. 7 is a graph showing a computation result of variations in improvement rate [(j/f)/(j/fplate)] of a ratio of a heat transfer-to-friction ratio (j/f) given as a ratio of a Colburn j-factor to a ventilation-relating friction coefficient 'f', against the amplitude-to-pitch ratio (a/p)

The amplitude-to-pitch ratio (a/p) represents a ratio of an amplitude 'a' of a waveform including one a wave crest 34 and one adjacent wave trough 36 (see FIG. 3) to a pitch 'p' as an interval of adjacent heat exchanging tubes 30 (see FIG. 3). In Inequality (1), 'Re' denotes a Reynolds number and is expressed by Re=up/ν, wherein 'u', 'p', and 'ν' respectively denote a bulk flow rate, the pitch, and a dynamic coefficient of viscosity. The left side of Inequality (1) is based on the computation result of an improvement rate (h/hplate) that is not lower than 2.0 in a range of the amplitude-to-pitch ratio (a/p) of greater than $1.3\times Re^{-0.5}$. The improvement rate (h/hplate) is computed as a ratio of a heat transfer coefficient 'h' of a corrugated plate with waveforms of the wave crests 34 and the wave troughs 36 to a heat transfer coefficient 'hplate' of a flat plate without such waveforms. FIG. 5 is a graph showing a computation result of variations in improvement rate (h/hplate) of the heat transfer coefficient against the amplitude-to-pitch ratio (a/p) with regard to various values of the Reynolds number Re. FIG. 6 is a graph showing a computation result of a variation in amplitude-to-pitch ratio (a/p) against the Reynolds number Re to give a heat transfer coefficient of not less than double the heat transfer coefficient of a comparative example. The computation result of FIG. 5 suggests the presence of an optimum amplitude-to-pitch ratio (a/p) for each value of the Reynolds number Re. The left side of Inequality (1) is introduced from the computation result of FIG. 6. The right side of Inequality (1) is based on the computation result of good heat transfer performance with restriction of the influence of the increasing ventilation resistance in a range of the amplitude-to-pitch ratio (a/p) of smaller than 0.2. FIG. 7 is a graph showing a computation result of variations in improvement rate [(j/f)/(j/fplate)] given as a ratio of a heat transfer-to-friction ratio (j/f) of the corrugated plate with waveforms of the wave crests 34 and the wave troughs 36 to a heat transfer-to-friction ratio (j/fplate) of the flat plate against the amplitude-to-pitch ratio (a/p) with regard to various values of the Reynolds number Re. The heat transfer-to-friction ratio (j/f) is given as a ratio of a Colburn j-factor to a ventilation-relating friction coefficient 'f'. The Colburn j-factor is a dimensionless number of the heat transfer coefficient. The heat transfer-to-friction ratio (j/f) is accordingly a ratio of the heat transfer performance to the ventilation resistance. The greater value of the heat transfer-to-friction ratio (j/f) indicates the higher performance of the heat exchanger. As clearly understood from the graph of FIG. 7, the improvement rate [(j/f)/(j/fplate)] of the heat transfer-to-friction ratio is not lower than 0.8 in the condition of the amplitude-to-pitch ratio (a/p) of not greater than 0.2. In the condition of the amplitude-to-pitch ratio (a/p) of greater than 0.2, the increasing ventilation resistance has the significant influence and undesirably lowers the performance of the heat exchanger. The amplitude 'a' of the waveform is not necessarily fixed but may be varied as long as the overall average of the amplitude-to-pitch ratio (a/p) satisfies Inequality (1) given above.

Each of the multiple heat exchanging tubes 30 of the embodiment is designed to have an interval-to-wavelength ratio (W/z) in a range of greater than 0.25 and less than 2.0 as shown by Inequality (2) given below:

$$0.25<W/z<2.0 \quad (2)$$

Figure 8:
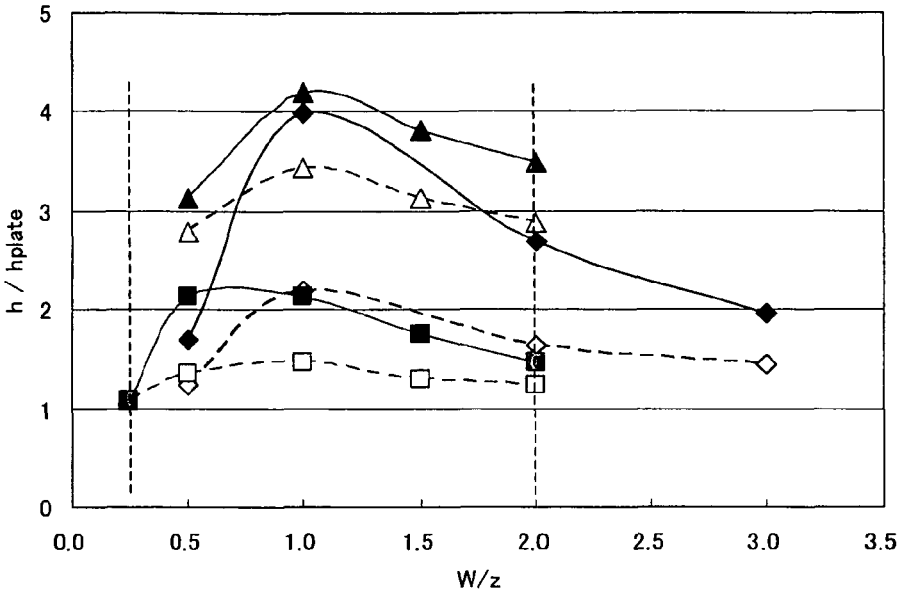
FIG. 8 is a graph showing a computation result of variations in improvement rate (h/hplate) of the heat transfer coefficient against the interval-to-wavelength ratio (W/z)

The interval-to-wavelength ratio (W/z) represents a ratio of the folding interval W (see FIG. 2) of the folding lines, which are arranged along the main stream of the air flow to symmetrically fold back the lines of the sequential wave crests 34 and the lines of the sequential wave troughs 36 (shown by the solid lines and the one-dot chain lines), to a wavelength 'z' of the waveform including one wave crest 34 and one adjacent wave trough 36 (see FIG. 3). This is based on the computation result suggesting the high improvement rate (h/hplate) of the heat transfer coefficient 'h' of the corrugated plate to the heat transfer coefficient 'hplate' of the flat plate in the interval-to-wavelength ratio (W/z) of greater than 0.25 and less than 2.0. FIG. 8 is a graph showing a computation result of variations in improvement rate (h/hplate) of the heat transfer coefficient against the interval-to-wavelength ratio (W/z) with regard to various values of the Reynolds number Re. The computation result of FIG. 8 suggests the high improvement rate (h/hplate) of the heat transfer coefficient in the interval-to-wavelength ratio (W/z) of greater than 0.25 and less than 2.0. As clearly understood from the graph of FIG. 8, the interval-to-wavelength ratio (W/z) is preferably in a range of greater than 0.25 and less than 2.0, more preferably in a range of greater than 0.5 and less than 2.0, and most preferably in a range of greater than 0.7 and less than 1.5. The wavelength 'z' of the waveform is not necessarily fixed but may be varied as long as the overall average of interval-to-wavelength ratio (W/z) satisfies Inequality (2) given above.

Each of the multiple heat exchanging tubes 30 of the embodiment is designed to have a curvature radius-to-wavelength ratio (r/z) in a range of greater than 0.25 as shown by Inequality (3) given below:

$$0.25<r/z \quad (3)$$

Figure 9:
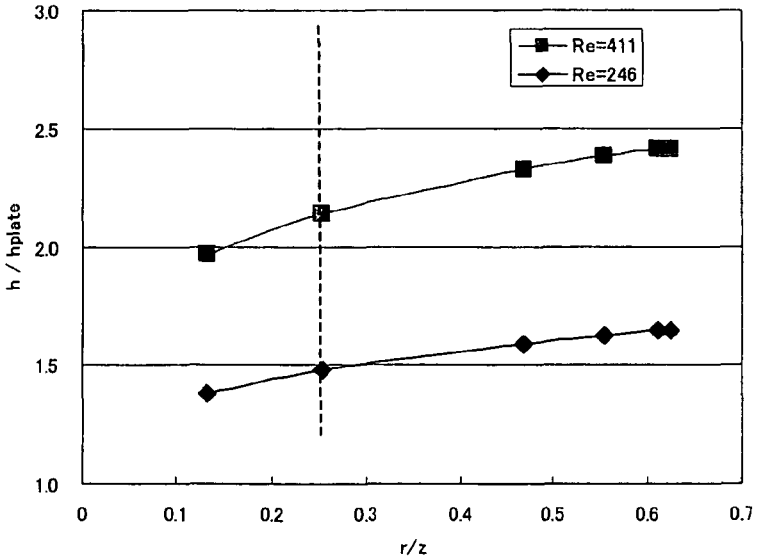
FIG. 9 is a graph showing a computation result of variations in improvement rate (h/hplate) of the heat transfer coefficient against the curvature radius-to-wavelength ratio (r/z)

The curvature radius-to-wavelength ratio (r/z) represents a ratio of the radius of curvature 'r' at the top of the wave crest 34 or at the bottom of the wave trough 36 (see FIG. 3) to the wavelength 'z' of the waveform including one wave crest 34 and one adjacent wave trough 36. This is based on the computation result suggesting the high improvement rate (h/hplate) of the heat transfer coefficient 'h' of the corrugated plate to the heat transfer coefficient 'hplate' of the flat plate in the condition of the curvature radius-to-wavelength ratio (r/z) of greater than 0.25. FIG. 9 is a graph showing a computation result of variations in improvement rate (h/hplate) of the heat transfer coefficient against the curvature radius-to-wavelength ratio (r/z) with regard to various values of the Reynolds number Re. The radius of curvature 'r' at the top of the wave crest 34 or at the bottom of the wave trough 36 relates to a local speed multiplication of the air flow running along the waveforms of the wave crests 34 and the wave troughs 36. Controlling such a local speed multiplication desirably prevents an increase of the ventilation resistance. There is accordingly an adequate range of the radius of curvature 'r'. The above range of the curvature radius-to-wavelength ratio (r/z) is given as the adequate range of the radius of curvature 'r' in relation to the wavelength 'z'. The computation result of FIG. 9 suggests the high improvement rate (h/hplate) of the heat transfer coefficient in the curvature radius-to-wavelength ratio (r/z) of greater than 0.25. As clearly understood from the graph of FIG. 9, the curvature radius-to-wavelength ratio (r/z) is preferably greater than 0.25, more preferably greater than 0.35, and most preferably greater than 0.5. The radius of curvature 'r' is not necessarily fixed but may be varied as long as the overall average of the curvature radius-to-wavelength ratio (r/z) satisfies Inequality (3) given above.

Figure 10:
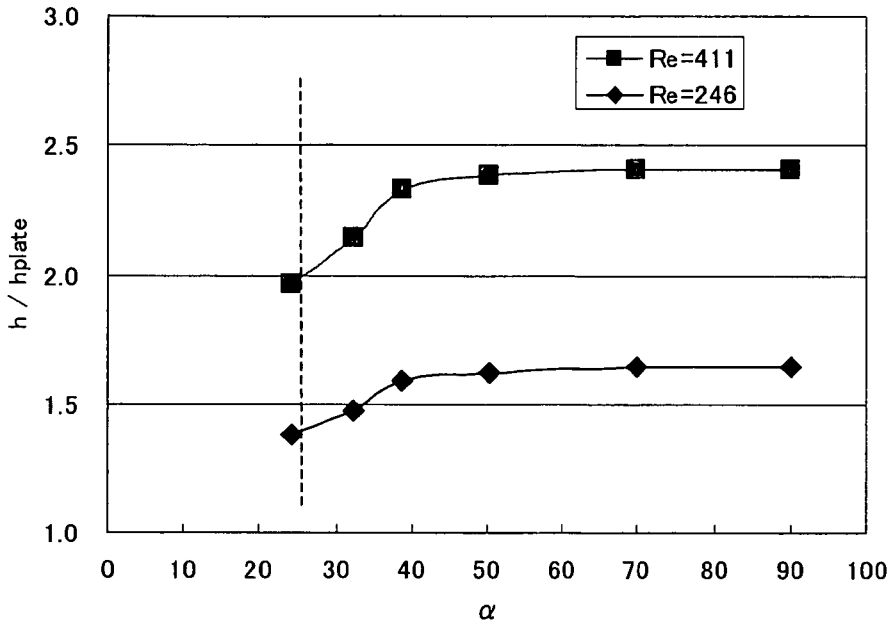
FIG. 10 is a graph showing a computation result of variations in improvement rate (h/hplate) of the heat transfer coefficient against the angle of inclination cc.

In the structure of the embodiment, the multiple lines of the sequential wave crests 34 and the multiple lines of the sequential wave troughs 36 formed on each of the multiple heat exchanging tubes 30 are arranged to have an angle of inclination α of not less than 25 degrees on the cross section of the waveform including one wave crest 34 and one adjacent wave trough 36 (see FIG. 3). This is based on the computation result suggesting the high improvement rate (h/hplate) of the heat transfer coefficient 'h' of the corrugated plate to the heat transfer coefficient 'hplate' of the flat plate in the angle of inclination α of not less than 25 degrees. This condition increases the air flow along the waveforms of the wave crests 34 and the wave troughs 36 and thereby ensures effective generation of the secondary flows of the air having contribution to the heat transfer. FIG. 10 is a graph showing a computation result of variations in improvement rate (h/hplate) of the heat transfer coefficient against the angle of inclination α with regard to various values of the Reynolds number Re. The computation result of FIG. 10 suggests the high improvement rate (h/hplate) of the heat transfer coefficient in the angle of inclination α of not less than 25 degrees. As clearly understood from the graph of FIG. 10, the angle of inclination α is preferably not less than 25 degrees, more preferably not less than 30 degrees, and most preferably not less than 40 degrees.

As described above, in the heat exchanger 20 of the embodiment, each of the flattened faces (front face and rear face) of the heat exchanging tube 30 is designed to have the multiple lines of the sequential wave crests 34 and the multiple lines of the sequential wave troughs 36 (respectively shown by the solid lines and the one-dot chain lines), which are arranged to have the preset angle γ (for example, 30 degrees) in the specific angle range of 10 degrees to 60 degrees relative to the main stream of the air flow and are folded back symmetrically about the folding lines of the preset interval (folding interval) W along the main stream of the air flow. This arrangement generates the effective secondary flows of the air and improves the heat transfer efficiency, thus enhancing the overall efficiency of heat exchange. The enhanced heat exchange efficiency allows production of the small-sized, high-performance heat exchanger 20. Formation of the multiple lines of the sequential wave crests (convexes) 34 and the multiple lines of the sequential wave troughs (concaves) 36 on each of the flattened faces (front face and rear face) of the heat exchanging tube 30 increases the strength on the flattened faces and enhances the pressure capacity of the flattened faces. The high rigidity of the flattened faces reduces the transmission coefficient of noise produced in the heat exchanging tubes 30, thereby giving the heat exchanger of the high quietness. The high rigidity of the heat exchanging tubes 30 reduces the potential deformation of the heat exchanging tubes 30 in the course of bending work and improves the assembling property of the heat exchanging tubes 30.

The heat exchanger 20 of the embodiment is assembled from the multiple heat exchanging tubes 30. Each of the multiple heat exchanging tubes 30 is formed to have the amplitude-to-pitch ratio (a/p) satisfying Inequality (1) given above. The amplitude-to-pitch ratio (a/p) represents the ratio of the amplitude 'a' of the waveform including one wave crest 34 and one adjacent wave trough 36 to the pitch 'p' or the interval between the adjacent heat exchanging tubes 30. This arrangement ensures the high heat transfer efficiency of the heat exchanger 20 and thereby allows further size reduction of the heat exchanger 20.

In the heat exchanger 20 of the embodiment, each of the multiple heat exchanging tubes 30 is formed to have the interval-to-wavelength ratio (W/z) in the range of greater than 0.25 and less than 2.0 as shown by Inequality (2) given above. The interval-to-wavelength ratio (W/z) represents the ratio of the folding interval W of the folding lines arranged along the main stream of the air flow to symmetrically fold back the lines of the sequential wave crests 34 and the lines of the sequential wave troughs 36 to the wavelength 'z' of the waveform including one wave crest 34 and one adjacent wave trough 36. This arrangement ensures the high heat transfer efficiency of the heat exchanger 20 and thereby allows further size reduction of the heat exchanger 20.

In the heat exchanger 20 of the embodiment, each of the multiple heat exchanging tubes 30 is formed to have the curvature radius-to-wavelength ratio (r/z) in the range of greater than 0.25 as shown by Inequality (3) given above. The curvature radius-to-wavelength ratio (r/z) represents the ratio of the radius of curvature 'r' at the top of the wave crest 34 or at the bottom of the wave trough 36 to the wavelength 'z' of the waveform including one wave crest 34 and one adjacent wave trough 36. This arrangement effectively controls a local speed multiplication of the air flow running along the waveforms of the wave crests 34 and the wave troughs 36 and thereby prevents an increase of the ventilation resistance. This gives the higher-performance heat exchanger 20.

In the heat exchanger 20 of the embodiment, each of the multiple heat exchanging tubes 30 is formed to have the angle of inclination $\alpha$ of not less than 25 degrees on the cross section of the waveform including one wave crest 34 and one adjacent wave trough 36. This arrangement ensures the high heat transfer efficiency of the heat exchanger 20 and thereby allows further size reduction of the heat exchanger 20.

Figure 11:
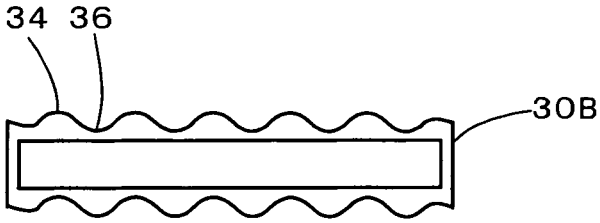
FIG. 11 is an explanatory view showing one modified structure of a heat exchanging tube 30B.
Figure 12:
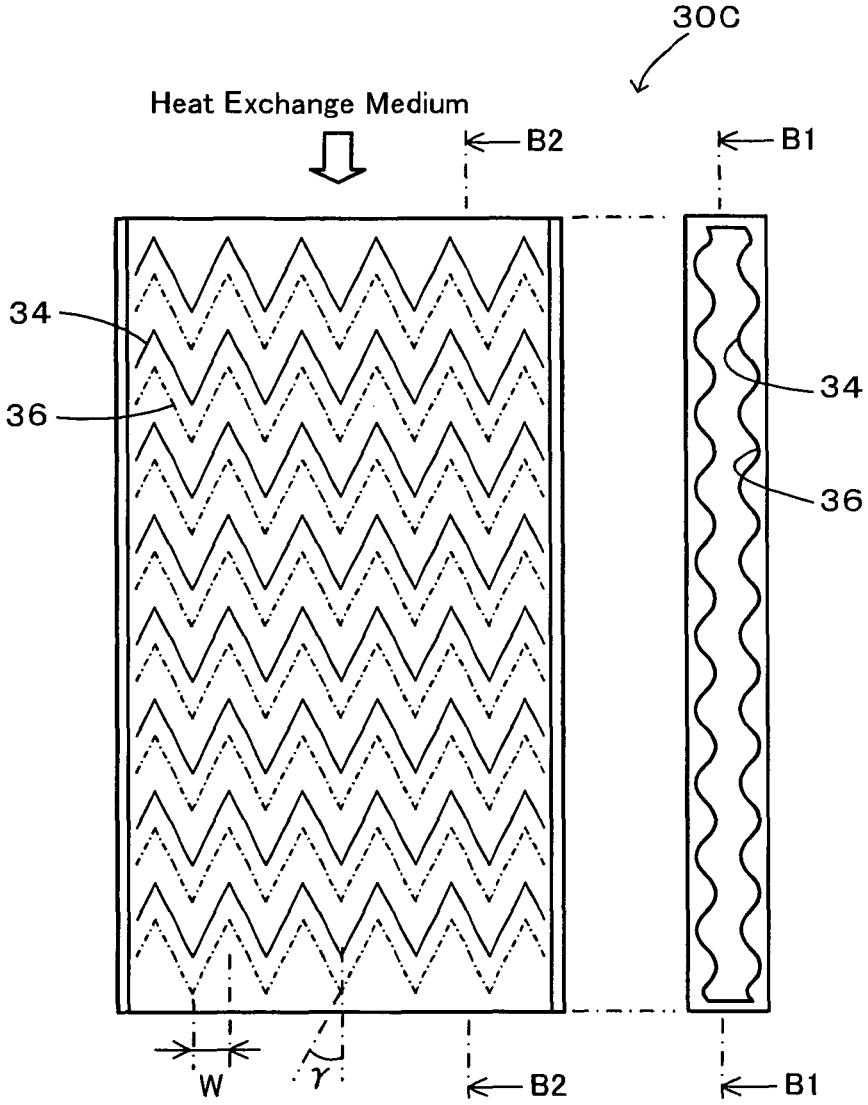
FIG. 12 is an explanatory view showing a B1-B1 cross section and a B2-B2 cross section of a heat exchanging tube 30C of the modified example.
Figure 13:
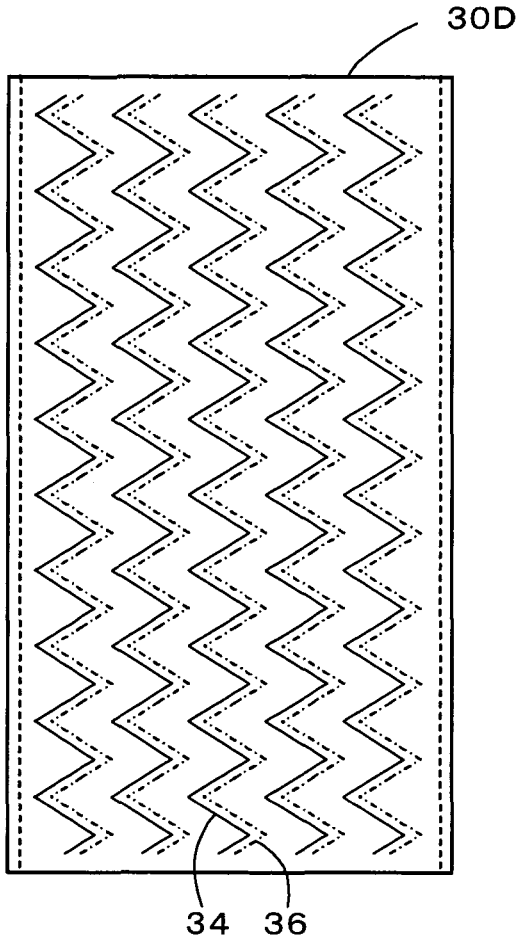
FIG. 13 is an explanatory view showing a heat exchanging tube 30D of the modified example.

In the heat exchanger 20 of the embodiment, each of the flattened faces (front face and rear face) of the heat exchanging tube 30 is formed as the corrugated plate with the multiple lines of the sequential wave crests (convexes) 34 and the multiple lines of the sequential wave troughs (concaves) 36. Namely each face of the heat exchanging tube 30 is worked to have the multiple lines of the sequential wave crests (convexes) 34 and the multiple lines of the sequential wave troughs (concaves) 36 both on its inner wall side and outer wall side. In one modified structure of FIG. 11, an outer wall side of each of flattened faces (front face and rear face) of a heat exchanging tube 30B is designed to have multiple lines of sequential wave crests (convexes) 34 and multiple lines of sequential wave troughs (concaves) 36, while an inner wall side of each flattened face is designed to have no such wave crests 34 or wave troughs 36. In this modified structure, the multiple lines of the sequential wave crests (convexes) 34 and the multiple lines of the sequential wave troughs (concaves) 36 may be formed by working on the outer wall side of each of the flattened faces (front face and rear face) of the heat exchanging tube 30B or may be attached to the outer wall side of each of the flattened faces (front face and rear face) of the heat exchanging tube 30B. Under the condition that the heat exchanging fluid flowing inside the heat exchanging tubes has the lower thermal conductivity than the heat exchanged fluid flowing outside the heat exchanging tubes, another modified structure may be adopted as shown in a heat exchanging tube 30C of FIG. 12. In the modified structure of FIG. 12, an inner wall side of each of flattened faces (front face and rear face) of the heat exchanging tube 30C is designed to have multiple lines of sequential wave crests (convexes) 34 and multiple lines of sequential wave troughs (concaves) 36, while an outer wall side of each flattened face is designed to have no such wave crests 34 or wave troughs 36. FIG. 12 shows a B1-B1 cross section and a B2-B2 cross section of the heat exchanging tube 30C of the modified example. As shown in still another modified structure of FIG. 13, each of flattened faces (front face and rear face) of a heat exchanging tube 30D may be designed to have multiple lines of sequential wave crests (convexes) 34 and multiple lines of sequential wave troughs (concaves) 36 arranged at varying intervals.

In the heat exchanger 20 of the embodiment, the air as the heat exchanged fluid flowing outside the heat exchanging tubes 30 has the lower thermal conductivity than the oil as the heat exchanging fluid flowing inside the heat exchanging tubes 30. The multiple lines of the sequential wave crests (convexes) 34 and the multiple lines of the sequential wave troughs (concaves) 36 are accordingly formed on each of the flattened faces (front face and rear face) of the heat exchanging tube 30 to have the angle $\gamma$ in the specific angle range of 10 degrees to 60 degrees relative to the main stream of the air flow. In one modification, the multiple lines of the sequential wave crests (convexes) 34 and the multiple lines of the sequential wave troughs (concaves) 36 may be formed to have the angle $\gamma$ in the specific angle range of 10 degrees to 60 degrees relative to a predetermined direction having a preset angle (for example, 5 degrees or 10 degrees) shifted from the main stream of the air flow.

The heat exchanger 20 of the embodiment is assembled by arranging the multiple heat exchanging tubes 30 in such a manner that the wave crests 34 and the wave troughs 36 formed on the outer wall side of each heat exchanging tube 30 are arranged parallel to the wave crests 34 and the wave troughs 36 formed on the outer wall side of adjacent heat exchanging tubes 30. In the structure of the embodiment, the wave crests 34 formed on one face of each heat exchanging tube 30 are opposed to the wave troughs 36 formed on an opposite face of an adjacent heat exchanging tube 30. Similarly the wave troughs 36 formed on one face of each heat exchanging tube 30 are opposed to the wave crests 34 formed on the opposite face of the adjacent heat exchanging tube 30. In one modified structure, the wave crests 34 and the wave troughs 36 formed on one face of each heat exchanging tube 30 may be respectively opposed to the wave crests 34 and the wave troughs 36 formed on the opposite face of the adjacent heat exchanging tube 30.

The heat exchanger 20 of the embodiment is assembled from the multiple heat exchanging tubes 30. Each of the multiple heat exchanging tubes 30 is formed to have the amplitude-to-pitch ratio (a/p) satisfying Inequality (1): $1.3\times Re^{-0.5}<a/p<0.2$ given above. The amplitude-to-pitch ratio (a/p) represents the ratio of the amplitude 'a' of the waveform including one wave crest 34 and one adjacent wave trough 36 to the pitch 'p' or the interval between the adjacent heat exchanging tubes 30. In one modified example, the heat exchanger 20 may be assembled from the multiple heat exchanging tubes 30 designed to have the amplitude-to-pitch ratio (a/p) out of the range defined by Inequality (1) given above.

In the heat exchanger 20 of the embodiment described above, each of the multiple heat exchanging tubes 30 is formed to have the interval-to-wavelength ratio (W/z), which is given as the ratio of the folding interval W of the folding lines arranged along the main stream of the air flow to symmetrically fold back the lines of the sequential wave crests 34 and the lines of the sequential wave troughs 36 to the wavelength 'z' of the waveform including one wave crest 34 and one adjacent wave trough 36, in the range of greater than 0.25 and less than 2.0 as shown by Inequality (2) given above. In one modified example, each of the multiple heat exchanging tubes 30 may be designed to have the interval-to-wavelength ratio (W/z) in the range of not greater than 0.25 or in the range of not less than 2.0.

In the heat exchanger 20 of the embodiment described above, each of the multiple heat exchanging tubes 30 is formed to have the curvature radius-to-wavelength ratio (r/z), which is given as the ratio of the radius of curvature 'r' at the top of the wave crest 34 or at the bottom of the wave trough 36 to the wavelength 'z' of the waveform including one wave crest 34 and one adjacent wave trough 36, in the range of greater than 0.25 as discussed above. In one modified example, each of the multiple heat exchanging tubes 30 may be designed to have the curvature radius-to-wavelength ratio (r/z) in the range of not greater than 0.25.

In the heat exchanger 20 of the embodiment described above, each of the multiple heat exchanging tubes 30 is formed to have the angle of inclination $\alpha$ of not less than 25 degrees on the cross section of the waveform including one wave crest 34 and one adjacent wave trough 36. In one modified structure, each of the multiple heat exchanging tubes 30 may be designed to have the angle of inclination $\alpha$ of less than 25 degrees.

In the heat exchanger 20 of the embodiment, each of the heat exchanging tubes 30 is constructed as a flattened tube of 0.5 mm in thickness by press work or bending work of the 0.1 mm-thick plate member of the stainless steel material. The thickness of the plate member is not restricted to 0.1 mm but may be determined arbitrarily according to the application of the heat exchanger 20. The thickness of the flattened tube is also not restricted to 0.5 mm but may be determined arbitrarily. For example, in application of the heat exchanger 20 for exhaust heat recovery, each of the heat exchanging tubes 30 may be made of a 0.3 mm to 1.5 mm-thick plate member to have a thickness of approximately 9 mm. The material of the heat exchanging tubes 30 is not restricted to the stainless steel material but may be selected adequately according to the variety of the heat exchanging fluid and the heat exchanged fluid.

In the heat exchanger 20 of the embodiment, the flow of the heat exchanging fluid flowing inside the heat exchange tube 30 is made substantially perpendicular to the flow of the heat exchanged fluid flowing outside the heat exchanging tube 30. In one modified arrangement, the flow of the heat exchanging fluid and the flow of the heat exchanged fluid may be made to be opposed to each other. In another modified arrangement, the flow of the heat exchanged fluid may be made to have a preset acute angle or a preset blunt angle to the flow of the heat exchanging fluid.

The embodiments and their modified examples discussed above are to be considered in all aspects as illustrative and not restrictive. There may be many other modifications, changes, and alterations without departing from the scope or spirit of the main characteristics of the present invention.

INDUSTRIAL APPLICABILITY

The technique of the present invention is preferably applied to the manufacturing industry of heat exchangers.

The invention claimed is:

1. A finless heat exchanger that is configured to cool or heat a heat exchanging fluid through heat exchange between the heat exchanging fluid and a heat exchanged fluid, the heat exchanger comprising:

a plurality of heat exchanging tubes, which are made of a thermally conducting material, formed as hollow tubes of a flattened cross section, and arranged in parallel with one another, such that heat exchange occurs between the heat exchanging fluid flowing inside the heat exchanging tubes and the heat exchanged fluid flowing between the heat exchanging tubes, a fluid flow direction of the heat exchanging fluid being substantially perpendicular to a fluid flow direction of the heat exchanged fluid; wherein:

the heat exchanging fluid flowing inside the heat exchanging tubes and the heat exchanged fluid flowing between the heat exchanging tubes do not mix;

each of the heat exchanging tubes is structured to have a line of sequential wave crests and a line of sequential wave troughs formed on at least one of an outer wall face and an inner wall face of the heat exchanging tubes for making flows of the respective fluids thereon such that the wave crests are spaced apart from the wave troughs at a regular preset interval, the line of sequential wave crests and the line of sequential wave troughs is arranged to have a preset angle in a specific angle range of 10 degrees to 60 degrees relative to a predetermined direction, and is symmetrically folded back about folding lines arranged at the preset interval along the predetermined direction, the line of sequential wave crests and the line of sequential wave troughs is formed by a continuous smooth curved surface so that a plurality of secondary flows having a smooth flow are generated on at least one of the outer wall face and the inner wall face of the heat exchanging tubes, and the line of sequential wave crests and the line of sequential wave troughs on one wall face of the heat exchanging tube is formed in such a manner as to be spaced from another line of sequential wave crests or another line of sequential wave troughs formed on an opposed wall face of the heat exchanging tube, and each of the heat exchanging tubes is structured to have the line of sequential wave crests and the line of sequential wave troughs arranged to satisfy Inequality (2) given below:

$$0.25<W/z<2.0 \quad (2)$$

where 'W' denotes the preset interval of the folding lines and 'z' denotes a wavelength of a waveform including one wave crest from the line of sequential wave crests and one wave trough from the line of sequential wave troughs.

2. The heat exchanger in accordance with claim 1, wherein each of the heat exchanging tubes is structured to have the line of sequential wave crests and the line of sequential wave troughs formed on a specific face for making thereon a flow of a fluid having a lower thermal conductivity between the heat exchanging fluid and the heat exchanged fluid.

3. The heat exchanger in accordance with claim 2, wherein each of the heat exchanging tubes is structured to have the line of sequential wave crests and the line of sequential wave troughs formed on an opposed face for making thereon a flow of a fluid having a higher thermal conductivity between the heat exchanging fluid and the heat exchanged fluid, in such a manner as to be arranged in a pair and in parallel with the line of sequential wave crests and the line of sequential wave troughs formed on the specific face for making thereon the flow of the fluid having the lower thermal conductivity.

4. The heat exchanger in accordance with claim 1, wherein each of the heat exchanging tubes is structured to have the line of sequential wave crests and the line of sequential wave troughs formed on at least the outer wall face thereof, and the heat exchanging tubes are assembled in such a manner as to make a line of sequential wave crests and a line of sequential wave troughs on the outer wall face of one heat exchanging tube parallel to a line of sequential wave crests and a line of sequential wave troughs on the outer wall face of an adjacent heat exchanging tube.

5. The heat exchanger in accordance with claim 1, wherein the predetermined direction is a direction of a main stream of a fluid flow.

6. The heat exchanger in accordance with claim 1, wherein each of the heat exchanging tubes is structured to have the line of sequential wave crests and the line of sequential wave troughs arranged to satisfy Inequality (1) given below:

$$1.3\times Re^{-0.5}<a/p<0.2 \quad (1)$$

where 'a' denotes an amplitude of the wave form that includes that one wave crest from the line of sequential wave crests and the one wave trough from the line of sequential wave troughs, 'p' denotes a pitch as an interval between the line of sequential wave crests and the line of sequential wave troughs formed on one face and the line of sequential wave crests and the line of sequential wave troughs formed on an opposed face arranged to be opposite to the one face across a fluid flow, and 'Re' denotes a Reynolds number defined by a bulk flow rate and the pitch 'p'.

7. The heat exchanger in accordance with claim 1, wherein each of the heat exchanging tubes is structured to have the line of sequential wave crests and the line of sequential wave troughs arranged to have an angle of inclination of not less than 25 degrees on a cross section of the waveform that includes the one wave crest from the line of sequential wave crests and the one wave trough from the line of sequential wave troughs.

8. The heat exchanger in accordance with claim 1, wherein each of the heat exchanging tubes is made of a metal material and is formed as a flattened hollow tube of a cross section having a thickness of not greater than 9 mm.

9. The heat exchanger in accordance with claim 1, wherein each of the heat exchanging tubes is made of a plate member having a thickness of not greater than 1.5 mm.

10. The heat exchanger in accordance with claim 1, wherein the heat exchanging tubes are assembled to make a flow of the heat exchanging fluid substantially perpendicular to a flow of the heat exchanged fluid as a whole.

11. The heat exchanger in accordance with claim 1, wherein a thickness inside the heat exchanging tubes is substantially constant along a length of the heat exchanging tubes.

12. The heat exchanger in accordance with claim 1, wherein the line of sequential wave crests and the line of sequential wave troughs on the one wall face of the heat exchanging tube is parallel to the another line of sequential wave crests or to the another line of sequential wave troughs formed on the opposed wall face of the heat exchanging tube.

13. The heat exchanger in accordance with claim 1, wherein the line of sequential wave crests and the line of sequential wave troughs on the one wall face of the heat exchanging tube is spaced apart from the another line of sequential wave crests or the another line of sequential wave troughs formed on the opposed wall face of the heat exchanging tube by only an open passage.

14. A finless heat exchanger that is configured to cool or heat a heat exchanging fluid through heat exchange between the heat exchanging fluid and a heat exchanged fluid, the heat exchanger comprising:

a plurality of heat exchanging tubes, which are made of a thermally conducting material, formed as hollow tubes of a flattened cross section, and arranged in parallel with one another, such that heat exchange occurs between the heat exchanging fluid flowing inside the heat exchanging tubes and the heat exchanged fluid flowing between the heat exchanging tubes, a fluid flow direction of the heat exchanging fluid being substantially perpendicular to a fluid flow direction of the heat exchanged fluid; wherein:

the heat exchanging fluid flowing inside the heat exchanging tubes and the heat exchanged fluid flowing between the heat exchanging tubes do not mix;

each of the heat exchanging tubes is structured to have a line of sequential wave crests and a line of sequential wave troughs formed on at least one of an outer wall face and an inner wall face of the heat exchanging tubes for making flows of the respective fluids thereon such that the wave crests are spaced apart from the wave troughs at a regular preset interval, the line of sequential wave crests and the line of sequential wave troughs is arranged to have a preset angle in a specific angle range of 10 degrees to 60 degrees relative to a predetermined direction, and is symmetrically folded back about folding lines arranged at the preset interval along the predetermined direction, the line of sequential wave crests and the line of sequential wave troughs is formed by a continuous smooth curved surface so that a plurality of secondary flows having a smooth flow are generated on at least one of the outer wall face and the inner wall face of the heat exchanging tubes, and the line of sequential wave crests and the line of sequential wave troughs on one wall face of the heat exchanging tube is formed in such a manner as to be spaced from another line of sequential wave crests or another line of sequential wave troughs formed on an opposed wall face of the heat exchanging tube, and each of the heat exchanging tubes is structured to have the line of sequential wave crests and the line of sequential wave troughs arranged to satisfy Inequality (3) given below:

$$0.25<r/z \quad (3)$$

where 'r' denotes a radius of curvature at a top of each wave crest from the line of sequential wave crests and/or at a bottom of each wave trough from the line of sequential wave troughs and 'z' denotes a wavelength of a waveform including one wave crest from the line of sequential wave crests and one wave trough from the line of sequential wave troughs.

* * * * *